US006189163B1

(12) United States Patent
Van Marcke

(10) Patent No.: US 6,189,163 B1
(45) Date of Patent: Feb. 20, 2001

(54) DEVICE FOR CONTROLLING A SERIES OF WASHROOM APPLIANCES

(76) Inventor: Karel Carl Van Marcke, Kasteelstraat 7, B-9770, Kruishoutem (BE)

( * ) Notice: Under 35 U.S.C. 154(b), the term of this patent shall be extended for 0 days.

(21) Appl. No.: 09/413,966

(22) Filed: Oct. 7, 1999

Related U.S. Application Data

(62) Division of application No. 08/805,293, filed on Feb. 25, 1997, now Pat. No. 6,000,429.

(30) Foreign Application Priority Data

Feb. 28, 1996 (EP) ..... 96-200513

(51) Int. Cl.[7] ..... E03C 1/05
(52) U.S. Cl. ..... 4/623; 4/628
(58) Field of Search ..... 4/623, 628, DIG. 3

(56) References Cited

U.S. PATENT DOCUMENTS

| | | | | |
|---|---|---|---|---|
| 4,735,357 | | 4/1988 | Gregory et al. | 4/623 X |
| 4,916,613 | * | 4/1990 | Lange et al. | 4/623 X |
| 5,313,673 | | 5/1994 | Saadi et al. | 4/313 |

FOREIGN PATENT DOCUMENTS

| | | |
|---|---|---|
| 0410001 | 1/1991 | (EP) . |
| 0487977 | 6/1992 | (EP) . |

OTHER PUBLICATIONS

European Search Report dated Jul. 19, 1996 pertaining to application No. 96–200513.8 (3 pp.).

European Search Report dated Jun. 11, 1997 pertaining to application No. 97–200527.6 (4 pp.).

* cited by examiner

*Primary Examiner*—Robert M. Fetsuga
(74) *Attorney, Agent, or Firm*—Cahill, Sutton & Thomas P.L.C.

(57) ABSTRACT

A device for automatically controlling the operation of a washroom appliance such as a water faucet, soap dispenser, shower, urinal, etc., comprising means for actuating said appliance, means for deactuating said appliance, a remote control arranged for emitting a signal, a receiver arranged for receiving said signal and for generating a maintenance signal in response to receipt of the signal from the remote control, and means responsive to the maintenance signal for generating an overruling signal for disabling said actuation means. The device comprises in a first aspect of the invention means for intermittently actuating and deactuating said receiver to reduce the power consumption thereof. In a second aspect, the invention relates to a device for automatically controlling flow of water in a wash fountain, including a maintenance function which enable to deactivate the wash fountain except for at least one valve to permit supply of water for cleaning the wash fountain.

11 Claims, 5 Drawing Sheets

DEVICE FOR CONTROLLING A SERIES OF WASHROOM APPLIANCES

This is a division of application Ser. No. 08/805,293 filed on Feb. 25, 1997 U.S. Pat. No. 6,000,429 of Karel Carl Van Marcke for "DEVICE FOR CONTROLLING A SERIES OF WASHROOM APPLIANCES"; which application is based on and claims priority to European Patent Application No. 96-200513.8 filed Feb. 28, 1996.

The present invention relates to a device for automatically controlling the operation of at least one washroom appliance such as a water faucet, soap dispenser, shower, urinal, etc., in particular the operation of a flow control valve of such an appliance, comprising:

at least one sensor provided for sensing the presence of a user in a close neighbourhood of said appliance and for generating a presence signal upon sensing said presence a control unit having an input for receiving said presence signal, which control unit is provided for generating a control signal on the basis of the received presence signals and for transmitting said control signal to means for actuating said appliance;

means for deactuating said appliance;

a remote control arranged for emitting a signal;

a receiver arranged for receiving said signal and for generating a maintenance signal in response to receipt of said signal from the remote control; and means responsive to the maintenance signal for generating an overruling signal for disabling said actuation means.

Such a device is known from EP-A-0 487 977. This European patent application discloses a toilet including an automatic flushing system actuated by an active infrared detection system. The automatic flushing system can be put out of order by means of a remote control operation device, in particular when a maintenance person enters the toilet to clean it. The remote control operation device comprises an infrared transmitter and a receiver for the infrared rays emitted by the remote control device. These infrared rays have to be emitted both to initiate and to stop the cleaning or maintenance function.

In EP-A-0 487 977 the power source for supplying the necessary electrical power to the automatic flushing device has not been specified. The present invention is, however, especially directed to automatic control devices which are powered by means of a low voltage power source, in particular a battery. In such a case, the longevity of the battery is of great importance. In this respect, the cleaning function of the known automatic flushing device has the disadvantage of requiring additional energy, in particular the receiver for detecting the infrared rays emitted by the remote control.

An object of a first aspect of the present invention is therefore to provide a new automatic control device which can be put in a maintenance or cleaning function by means of a remote control device without making it impractical to still use a battery as power source.

To this end, the device according to the first aspect of the present invention is characterised in that said device comprises means for intermittently actuating and deactuating said receiver to reduce the power consumption thereof.

In an advantageous embodiment of the device according to the invention the receiver is actuated at least once per second. In this way, the intermittent activation of the receiver will not be noticeable at all in practice for a person operating the remote control but the energy requirements can be kept to a minimum.

In a second aspect, the present invention also relates to a device for automatically controlling flow of water in a wash fountain through a series of water nozzles connected to separate water supply valves, in particular a device according to the above described first aspect of the invention, which device comprises:

a series of sensors assigned to said nozzles, which sensors are provided for sensing the presence of a user in close neighbourhood to the nozzle they are assigned to and for generating a presence signal upon sensing said presence;

a control unit provided for generating a control signal upon receipt of said presence signal and for transmitting said control signal to valve actuation means arranged to open the water valve of said corresponding nozzle in response to receipt of said control signal; and valve deactuation means for closing said water valve again.

Such a device is known from EP-A-0 574 372 and is used as system for automatically controlling i.a. water valves and soap valves in a wash fountain. The wash fountain may contain either one common water valve or several water valves, one for each water nozzle. In the latter case, a number of passive infrared sensors are provided for detecting the presence of a user near the respective water nozzle of the wash fountain.

A problem arises when the wash fountain has to be cleaned since the device automatically detects the presence of the maintenance person and therefore activates the water and soap nozzles, which is not desired at that moment. The person therefore has to deactivate the device for example by removing the battery or switching off the mains from the device or by closing for example the main water and/or soap supply. This operation is relatively cumbersome, since the battery and the water and/or soap supply are normally well concealed to prevent vandalism and consequently not easily accessible. Moreover, closing the water supply of one wash fountain might require to close the water supply of an entire building. Additionally, in order to reactivate the wash fountain, the person may not forget to reinstall the battery in the device or to reopen the supply after maintenance.

Another important drawback is that when deactivating the entire wash fountain in any of the above described ways, the maintenance person can no longer take any water to clean the wash fountain and has therefore to provide the necessary supply of water.

An object of the second aspect of the invention is therefore to provide means in the device to allow maintenance without requiring a cumbersome operation such as removing the battery from the device or closing the water and/or soap supply and which moreover to permit cleaning the wash fountain without having to provide a supply of cleaning water.

To this end, the device according to the second aspect of the invention is characterised in that said device further comprises maintenance means including means for generating a maintenance signal and means responsive to said maintenance signal for generating an overruling signal for preventing opening of all but at least one of said water valves during a predetermined period of time and for allowing opening of said water valves again after said predetermined period of time has lapsed.

The maintenance signal can be generated for example in response to a signal emitted by means of a remote control or even more simply in response to a signal generated by the device itself in particular in response to depression of a push button. Before starting to maintain the wash fountain, the maintenance person can simply give the required signal in response to which the overruling pulse is generated. In this way, actuation of said wash fountain is prevented during the predetermined period of time of for example two minutes so that during this period of time the presence of the persons in the neighbourhood of the device does not cause flow of water through the wash fountain, at least not through most of the water nozzles. No cumbersome operation is thus needed for allowing to clean the wash fountain. After this period of time, the person does not have to execute any actions, since the activation is automatically enabled and the device returns automatically to its normal operating condition.

An important feature of this second aspect of the invention is further that the maintenance function enables deactuation of less than all of the water valves and maintains at least one water valve active so that the person may use the water flowing through this valve to clean the wash fountain. After this initial phase, all the water valves, i.e. also the water valve(s) which were not inoperative during the initial phase, may be kept closed for a second predetermined period of time of, for example 30 seconds, so that the wash fountain can be dried by the maintenance person. After this second period of time, the device automatically returns to its normal operating condition since the activation is automatically enabled.

According to a first preferred embodiment of the device according to the invention, said maintenance means include further means responsive to said maintenance signal for opening said at least one water valve within said predetermined period of time and for closing said at least one water valve again, preferably within said period of time. In this embodiment, the maintenance person will thus automatically receive water to clean the wash fountain and will have at the end some time to dry it.

In an alternative embodiment, said maintenance means include further means responsive to said maintenance signal for preventing opening of said at least one water valve of said series within said period of time but only after a predetermined delay period of time has lapsed. Compared to the previous embodiment, this water valve may not automatically be opened but only in response to the presence of a person near the respective water nozzle, in particular the maintenance person who needs water.

According to a second preferred embodiment of the device according to the invention, said maintenance means include further means responsive to said maintenance signal for preventing also opening of said at least one water valve of said series within said period of time and switching means for either actuating or deactuating these means. By means of these switching means, a choice can thus be made whether all or only part of the water valves will be kept closed.

The invention will now be described with reference to the following figures.

In the following description, an example will be described of a preferred embodiment of the device according to the invention for controlling the operation of a series of washroom appliances comprising i.a. five water valves and five soap valves. It is clear that the device according to the invention can also be used for controlling the operation of one single washroom appliance, for example one water valve of a faucet, a shower, etc., a flush valve of a urinal, toilet, etc., or a soap valve for a soap dispenser, or for controlling the operation of a series of water valves or soap valves only. The device according to the invention can further also be used in soap dispensers, urinals, showers, . . .

Figure 1:
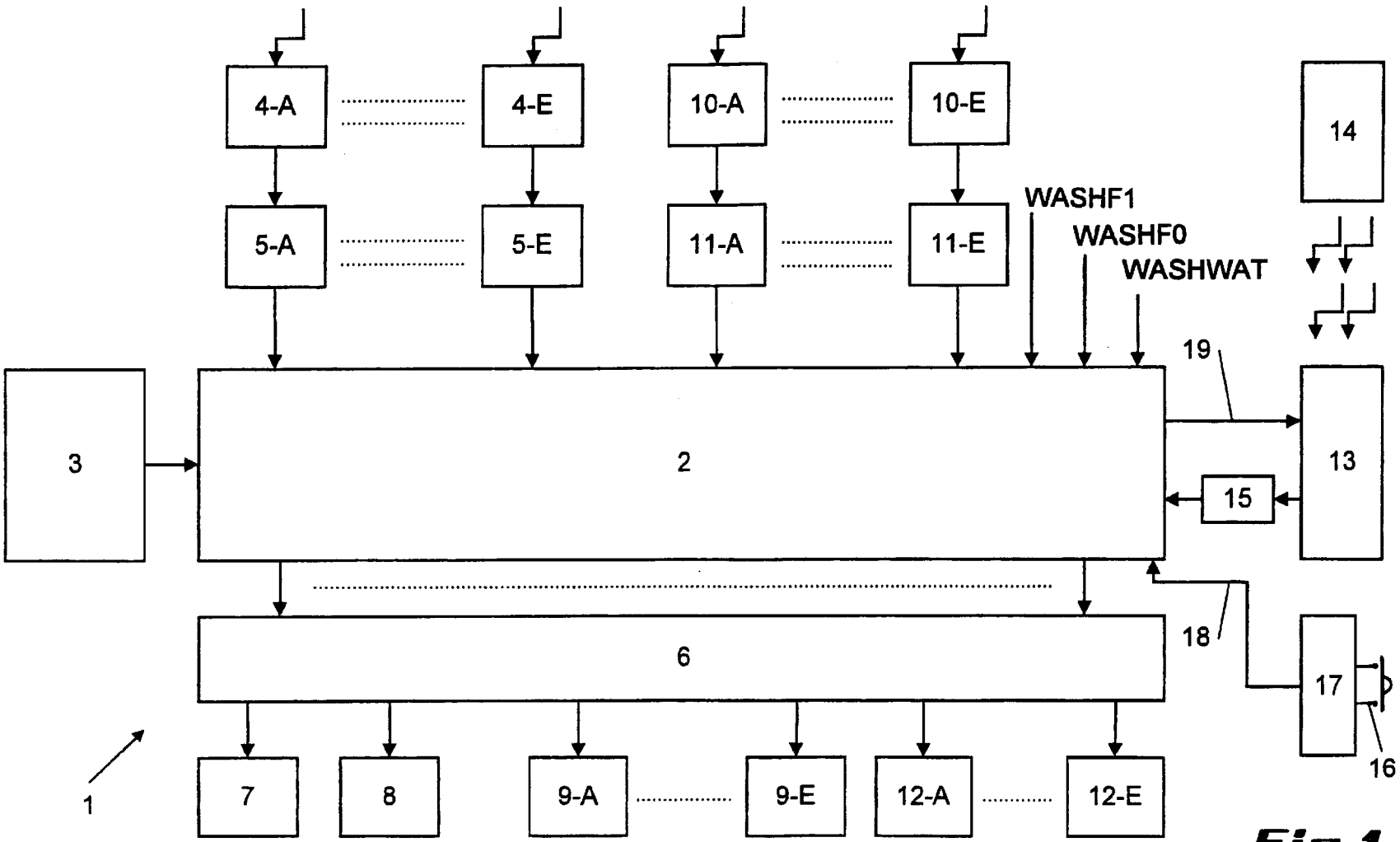
FIG. 1 is a block diagram illustrating an embodiment of the device of the present invention.
Figure 7:
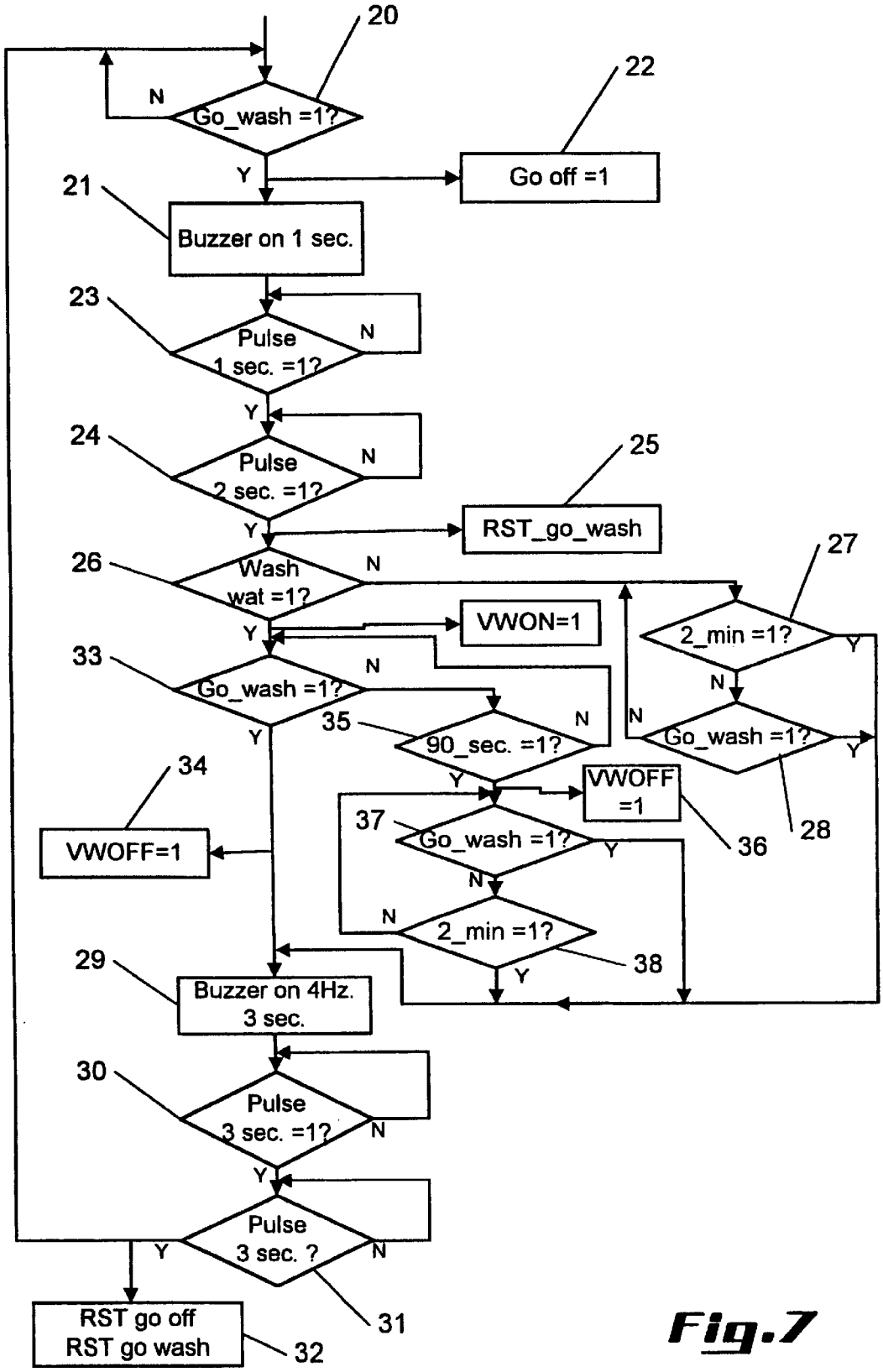
FIG. 7 is a flowchart illustrating the maintenance function performed by the control unit of the device illustrated in FIG. 1.

Referring to FIG. 1, the device 1 according to the invention includes an integrated circuit control chip 2. The steps for performing the functions upon maintenance set forth in the flowchart of FIG. 7 are performed under control of the control chip 2, more particularly by logic circuitry contained therein. Other known functions for controlling the operation of the appliances to which the control chip 2 is connected are also performed under control of this control chip 2. These known functions are described in detail in EP-A-0 574 372, corresponding with U.S. Pat. No. 5,217,035, which is incorporated herein by way of reference.

The control chip 2 comprises several inputs and outputs to which different components are connected. A first series of sensors 4-A to 4-E, in particular infrared sensors, is connected to the control chip 2 through the intermediary of a first series of amplifier/filter circuits 5-A to 5-E, respectively. This first series of infrared sensors 4-A to 4-E is provided for being positioned beneath corresponding water faucet or fountain nozzles. Similarly, a second series of infrared sensors 10-A to 10-E is connected to the control chip 2 through the intermediary of a second series of amplifier/filter circuits 11-A to 11-E, respectively. This second series of infrared sensors 10-A to 10-E is provided for being positioned beneath corresponding soap dispensers.

The device 1 comprises further a battery level control circuit 3 connected to the control chip 2, the functioning and structure of which has also been described in EP-A-0 574 372. Several outputs of the control chip 2 are connected to the I/O circuits 6, which in turn have outputs connected to a buzzer 7 and appliances of the device, more particularly actuation means 8 of an external device such as a hand dryer or towel dispenser, a series of water valves 9-A to 9-E respectively connected to the water faucets or fountain nozzles and a series of soap valves 12-A to 12-E respectively connected to the soap dispensers.

According to the invention, the device comprises further maintenance means. In the embodiment shown in FIG. 1, the maintenance means comprise a remote control 14, provided for emitting a signal to a receiver 13. The receiver 13 is connected to the control chip 2 via stabilizing circuitry 15 provided for generating, upon receipt of the output signal of the receiver, a maintenance signal to be supplied to an input of the control chip 2. The maintenance means further comprise a push button 16 or a similar switch incorporated in circuitry 17 which is also arranged for transmitting a maintenance signal to the control chip, in particular via conduit 18 to a different input of the control chip. The receiver 13 and the circuitry 15 and 17 are connected to the VDD of the control chip 2 through separate conduits which have not been shown in FIG. 1. By means of two dip switches, which are also connected to the control chip, namely to inputs WASHF1 and WASHF0, but which have not been shown, it is possible to make a selection between the maintenance function either by means of the remote control 14, by means of the push button 16 or by both of these possibilities or to deactivate the maintenance function.

Figure 2:
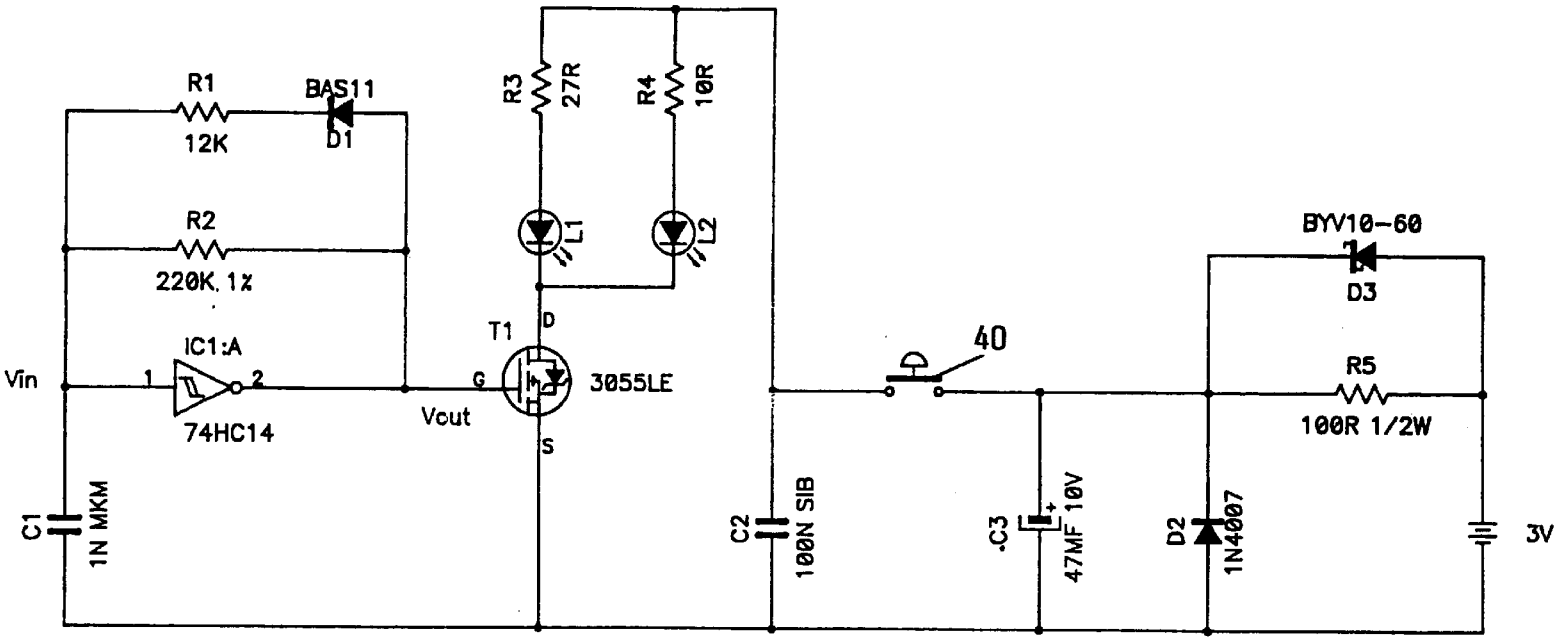
FIG. 2 illustrates the circuit of the remote control of the device of FIG. 1.
Figure 3:
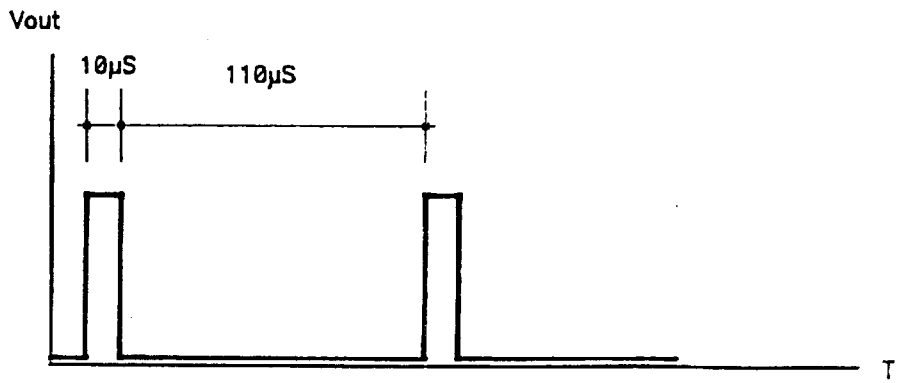
FIG. 3 illustrates the signal emitted by the remote control shown in FIG. 2.

Referring to FIG. 2, there is illustrated a block diagram of a possible circuit of the remote control 14. This circuit comprises i.a. a push button 40, an infrared light emitting diode L1, and a red indicator LED L2. When push button 40 is depressed, the LED L1 transmits a signal for the receiver consisting of a continuous series of pulses generated through the intermediary of transistor T1 and a pulse generating circuit including capacitor Ci, resistors R1 and R2, diode D1 and an inverting Schmitt trigger IC1. The output signal of this Schmitt trigger controlling the operation of transistor T1 and thus corresponding to the signal emitted by LED L1 is illustrated in FIG. 3. This signal consists, for example, of block pulses having a pulse width of 10 $\mu$sec and emitted at a frequency of $1/120$ $\mu$sec. Other details of the remote control will not be described as a person skilled in the art can deduce them from the block diagram and since it is possible to conceive various different kinds of other remote controls.

Figure 4:
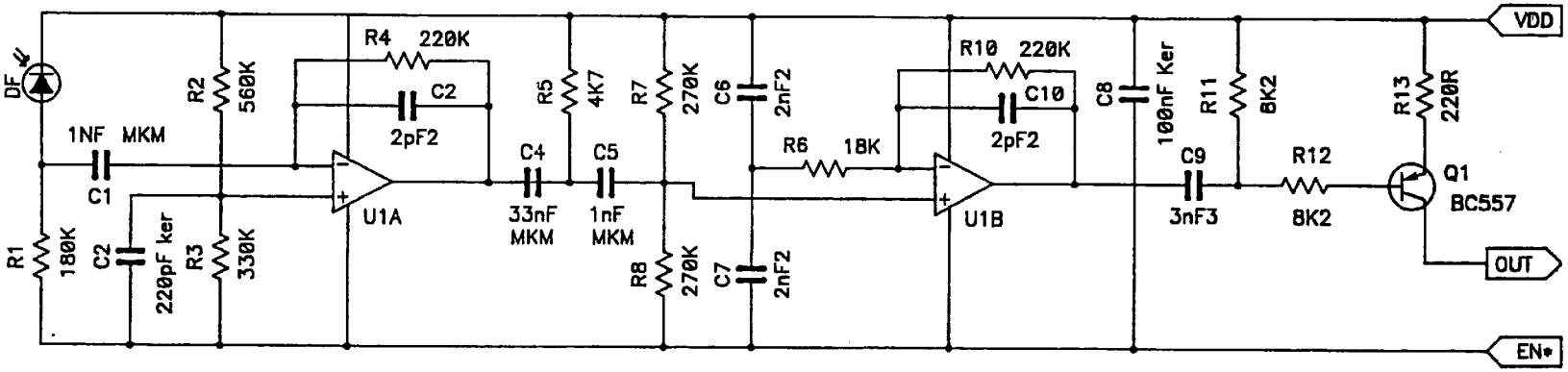
FIG. 4 illustrates the circuit of the receiver of the device of FIG. 1.

A block diagram of the receiver, which will also be explained only in broad outline, is illustrated in FIG. 4. The pulsed signals emitted by the remote control 14 are received by a receiver diode DF and subsequently filtered and amplified by the different components of the receiver. The resulting signals control the operation of transistor Q1 which transforms the signals from high impedance output to low impedance output signals of the receiver.

An important feature of the first aspect of the invention is that the receiver 13 is not activated all the time but each time only during a so-called "window" of for example 3 msec. This can be achieved under control of the control chip 2 which transmits for example every second an enabling signal via conduit 19 to receiver 13 to actuate it for 3 msec., i.e. for the duration of the enabling pulse. The actual detection of the maintenance signal, i.e. of the pulses transmitted by the receiver to the control chip is preferably started only about for example 2 msec. after having activated the receiver, i.e. after the receiver has come back to an equilibrium. The actual detection in the control chip 2 is in other words only carried out for the last third millisecond of the maintenance signal. Deactivation of the receiver 13 is done in view of reducing the energy consumption of the device, i.e. for making it practical to use a low power voltage source such as a battery as power source. Indeed, due to the different filtering and especially amplifying elements of the receiver, it would otherwise require too much energy. Control chip 2 and the components connected thereto and the various water and soap valves 9-A to 9-E and 12-A to 12-E are more particularly for example powered by a battery pack of about 9 Volts (not shown).

Figure 5:
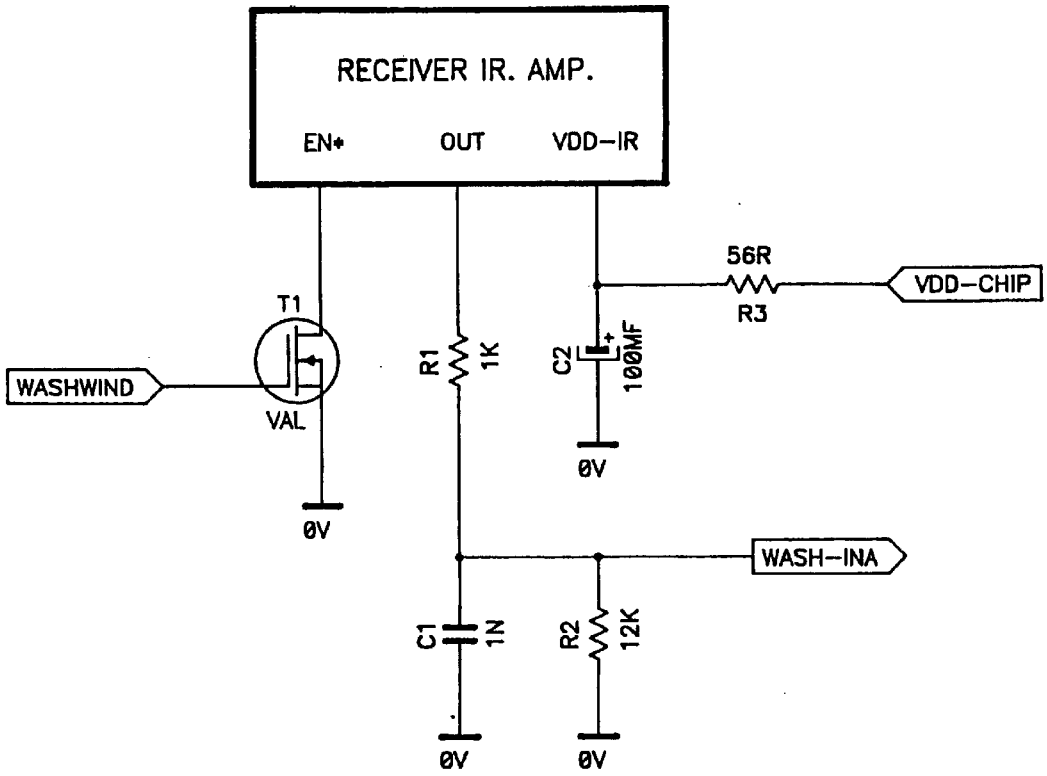
FIG. 5 illustrates the circuitry generating the maintenance signal WASH-INA in response to receipt of the output signal of the receiver.

The output signal of the receiver 13 is not directly transmitted to the control chip but instead via circuitry or electronic components 15 for stabilizing the signal again on the input of control chip 2. A block diagram of these components is illustrated in FIG. 5 even as a transistor T1 providing the enabling signal to the receiver under the control of a WASHWIND signal generated by the control chip 2. The output WASH-INA of circuitry 15 corresponds to the above-defined maintenance signal transmitted to an input of the control chip.

Figure 6:
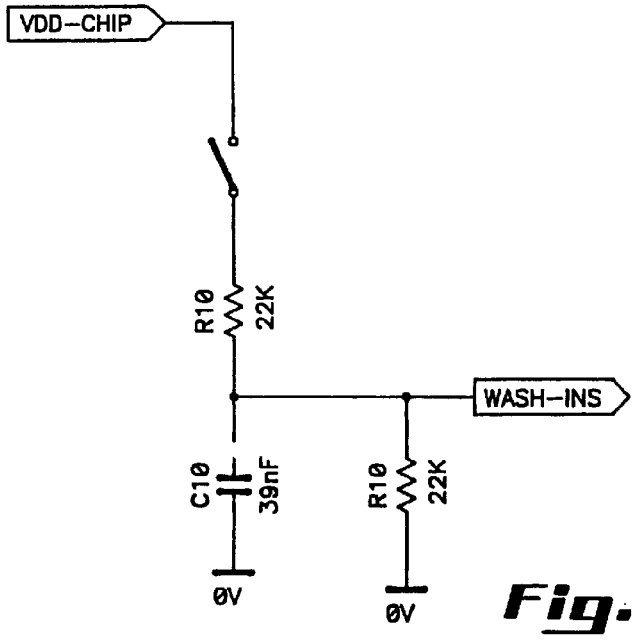
FIG. 6 illustrates the circuitry for generating the maintenance signal WASH-INS by means of the push button of the device itself.

The different components of circuitry 17, which enables to activate the maintenance function by means of the push button 16, is illustrated in FIG. 6. Upon depressing button 16, this circuitry 17 produces an output signal WASH-INS, corresponding also to the above-defined maintenance signal, starting from the VDD received from the control chip 2.

Both inputs of the control chip 2 for the maintenance signals (WASH-INA and WASH-INS) generated by means of the receiver 13 and circuitry 15 or by means of the push button circuitry 17 comprises preferably a Schmitt trigger producing for example on its output a voltage of 0 volt in case of an incoming maintenance signal between 0 and 1.5 Volts and a voltage of 5 Volts in case the incoming maintenance signal has a voltage of 3.5 to 5 Volts. For a maintenance signal received from circuitry 17, the maintenance function of the control chip is activated, i.a. an overruling signal is generated, upon receipt of the first positive pulse edge whereas for a maintenance signal received from the receiver 13 and circuitry 15, a number of for example four positive pulse edges are preferably to be received before activating the maintenance function.

The operation of the device according to the invention will now be described including first of all a description of the functions performed by the device upon detection of the presence of a human body part but this only in broad outline since a detailed description hereof is already given in EP-A-0 574 372. Upon presence of a user's hand adjacent to one of the infrared sensors, for example sensor 4-A, a. presence signal will be generated by the sensors 4-A and transmitted to the control chip 2, through the intermediary of the amplifier/filter circuit 5-A. Upon receipt of the presence signal, the control chip 2 generates a control signal and transmits this control signal to the water valve 9-A through the intermediary of the I/O circuits 6. The water valve 9-A, having received the control signal, will be actuated to supply water to the user. The other water valves 4-B to 4-E and the soap valves 12-A to 12-E are actuated in the same manner. In this way, the five sensors 4-A to 4-E control individual water valves of a wash basin, wash fountain, or the like in response to movement or presence of a user's hand close to water valves and the five infrared sensors 10-A to 10-E control individual soap valves of soap dispensers in response to movement or presence of a user's hand close to the soap valves. The actuation means 8 are for example enabled after a predetermined time after one of the water valves has been activated. Alternatively, an additional sensor is connected to the control chip 2 for controlling the operation of the actuation means 8.

Before starting to maintain the washroom appliances, the maintenance person, provided with the remote control 14 generates a signal by means of the remote control 14. This signal is transmitted to the receiver 13, which upon receipt of the signal transmits a maintenance signal to the control chip. When an appropriate maintenance signal is detected by the control chip, the maintenance function is actuated as explained hereinabove. Referring now to FIG. 7, the flowchart shows the sequence of operations and decisions performed by logic elements in control chip 2 to control the maintenance function.

In order to start the maintenance routine, variable GO WASH is first of all set to 1. In decision block 20, the value of the variable GO WASH is tested. If this value is 0, the test is performed again whilst in case the value is 1, buzzer 7 is activated for one second (operation block 21) to inform the maintenance person that the maintenance routine has been started. At the same time, a variable GO OFF is set to 1 (block 22) causing a reset of all the counters in the control chip and a termination of all the functions which are activated, i.e. the valves which were open at the start of the maintenance routine are closed and all of the valves are prevented from opening, at least by the normal automatic control functions by sensors 4A-4E and 10A-10E. Interrogator 23 provides a delay of 1 second, i.e. the duration of the activation of the buzzer 7, and interrogator 24 provides a further delay of 2 seconds. After this delay, the GO WASH variable is reset in block 25 to 0.

In the embodiment shown in FIG. 7, there are now two different possible routines for the maintenance function, which can be selected by a further dip switch determining the value of variable WASH WAT.

In case WASH WAT is equal to 0, which is tested by interrogator 26, a maintenance routine is started wherein all the valves and possible other appliances are kept deactivated for 2 minutes through the intermediary of decision block 27, unless the GO WASH variable has in the meantime been set to 1 again, as tested by interrogator 28. In the latter case, or in case the 2 minute delay has lapsed, the buzzer 7 is activated again, but now for 3 seconds at a frequency of 4 Hz instead of at a constant level for 1 second, under control of operation block 29. Interrogator 30 provides for a same delay of 3 seconds and interrogator 31 for an additional delay or recovery time of 3 seconds, after which the variables GO OFF and GO WASH are reset to 0 in block 32.

In the second possible routine for the maintenance function, i.e. in case the variable WASH WAT is equal to 1, one of the water valves 9 is automatically opened to provide water for cleaning in particular the wash fountain. In a variant embodiment, it may be possible to open this valve only upon detection of the presence of a human body part adjacent the corresponding sensor 4. In a next step, the GO WASH variable is tested in block 33. If this variable has been set again to 1, by a new detection of the maintenance signal during the maintenance routine itself, the maintenance routine is prematurely ended by closing the open water valve (block 34) and by going directly to operation block 29, by which the buzzer 7 is activated for 3 seconds. This procedure is carried out for 90 seconds under control of interrogator 35. After this delay period of 90 seconds, the open water valve is closed under control of operation block 36 and the testing of the GO WASH variable is continued by interrogator 37. In case the value of GO WASH is 1, the maintenance routine is prematurely terminated by going again directly to operation block 29 for activation the buzzer 7. This procedure is continued for 30 seconds through the intermediary of interrogator 38. After the delay period of 30 seconds, i.e. after a total period of 2 minutes, the maintenance routine is thus terminated in case no new maintenance signal has been given within this period.

From the above description it will be clear that many modifications can be applied to the embodiment of the maintenance function described with reference to a control chip provided for controlling a number of different appliances, including water and soap valves of a wash fountain.

It is for example possible to apply this maintenance feature to a soap dispenser comprising one single soap valve. In such a case, it is important to prevent flow of soap out of the dispenser to enable to clean it. The same goes for one or a series of showers. The maintenance feature can further be applied to an automatic control system for urinals, toilets, etc. involving another operation mode, i.e. an actuation of the flush valves after the user has left instead of upon arrival of the user. The control device disclosed in EP-A-0 574 372, the description of which is included herein by way of reference, comprises for example a dip switch X4 for making a selection between a wash fountain control and a urinal control.

Further dip switches may be provided for adjusting the different time delays, etc.

Finally, it will be clear that the detection system does not have to be a passive infrared or another passive system but that also so-called active detection systems based on emitted infrared beams, sound waves, etc. can be used. When use is made of a battery as power source, these detection systems should however require as less energy as possible, for example by applying active and passive states.

The remote control may on the contrary require more energy as it is not continuously used. It can emit, as described, infrared signals or alternatively ultrasonic or electromagnetic signals. These signals may be coded so that the maintenance routine can only be initiated by means of a suitable remote control device.

When use is made of a mechanical switch for initiating the maintenance routine, special measures may be taken to avoid vandalism or abuse. The push button may for example be replaced by a magnetically operable switch as disclosed in US-A-5 313 673.

What is claimed is:

1. A device for automatically controlling flow of water in a wash fountain through each water nozzle of a series of water nozzles connected to separate water valves, said device comprising in combination:

(a) each sensor of a series of sensors assigned to one nozzle of said series of nozzles for sensing the presence of a user in close proximity to the respective nozzle of said series of nozzles and for generating a presence signal upon sensing the presence of a user;

(b) a control unit for generating a control signal upon receipt of a presence signal from one sensor of said series of sensors and for transmitting said control signal to valve actuation means adapted to open the water valve of the nozzle assigned to said sensor generating said presence signal in response to receipt of said control signal;

(c) valve deactuation means for closing the actuated water valve; and (d) maintenance means comprising means for generating a maintenance signal and means responsive to said maintenance signal to prevent opening of all but at least one water valve of said water valves during a predetermined period of time and for allowing opening of said water valves again after said predetermined period of time has lapsed.

2. The device as set forth in claim 1 wherein said maintenance means includes means responsive to said maintenance signal for opening said at least one water valve within the predetennined period of time and means for closing said at least one water valve.

3. The device as set forth in claim 2 wherein said closing means closes said at least one water valve within said predetermined period of time after a predetermined delay period of time has lapsed.

4. The device as set forth in claim 1 wherein said maintenance means includes means responsive to said maintenance signal for preventing opening of said at least one water valve of said series of water valves within said predetermined period of time and switching means for either actuating or deactuating said preventing means.

5. The device as set forth in claim 1 wherein said maintenance means includes means responsive to said maintenance signal for opening said at least one water valve within the predetermined period of time and means for closing said at least one water valve, and means responsive to said maintenance signal for preventing opening of said at least one water valve of said series of water valves within said predetermined period of time and switching means for either actuating or deactuating said preventing means said switching means being adjustable for enabling either said opening means to open said at least one valve or said preventing means to prevent opening of said at least one water valve.

6. The device as set forth in claim 1 wherein said maintenance means includes means responsive to said maintenance signal for preventing opening of said at least one water valve of said series of water valves within said predetermined period of time but only after a predetermined delay period of time has lapsed.

7. The device as set forth in claim 1 including a source of soap, a series of soap nozzles and each of a series of soap supply valves interconnecting each soap nozzle of said series of soap nozzles with said source of soap, means for automatically controlling flow of soap into said wash fountain from each nozzle of said series of nozzles including means for preventing opening of each soap supply valve of said soap supply valves during said predetermined period of time.

8. A device as set forth in claim 1 wherein said maintenance means include means responsive to generation of a next maintenance signal within said predetermined period of time for allowing opening of said series of water valves before said predetermined period of time has lapsed.

9. A device as set forth in claim 7 wherein said maintenance means include means responsive to generation of a next maintenance signal within said predetermined period of time for allowing opening of said series of soap valves before said predetermined period of time has lapsed.

10. A device as set forth in claims 1 wherein said maintenance means comprises at least one buzzer and means responsive to said maintenance signal for actuating the buzzer a first time in response to the maintenance signal and a second time when opening of said water valves is again allowed.

11. The device as set forth in claim 2 wherein said maintenance means includes means responsive to said maintenance signal for preventing opening of said at least one water valve of said series of water valves within said predetermined period of time and adjustable switching means for enabling either said opening means to open said at least one valve or said preventing means to prevent opening of said at least one water valve.

* * * * *